US006264100B1

(12) United States Patent
Brown et al.

(10) Patent No.: US 6,264,100 B1
(45) Date of Patent: Jul. 24, 2001

(54) PAPER CUP BOTTOMS AND METHODS AND APPARATUS FOR FORMING SAME

(75) Inventors: David C. Brown, Clark Summit, PA (US); Grigory Grishchenko, River Edge, NJ (US); Anthony N. Curcio, Wind Gap, PA (US)

(73) Assignee: Fort James Corporation, Deerfield, IL (US)

( * ) Notice: Subject to any disclaimer, the term of this patent is extended or adjusted under 35 U.S.C. 154(b) by 0 days.

(21) Appl. No.: 09/676,950

(22) Filed: Oct. 2, 2000

Related U.S. Application Data

(62) Division of application No. 09/251,355, filed on Feb. 17, 1999, now Pat. No. 6,135,936.

(51) Int. Cl.[7] ..... B65D 3/12
(52) U.S. Cl. ..... 229/400; 229/4.5; 229/5.5
(58) Field of Search ..... 229/400, 4.5, 5.5, 229/5.8

(56) References Cited

U.S. PATENT DOCUMENTS

| | | | | |
|---|---|---|---|---|
| 3,118,351 | | 1/1964 | Jagenberg . | |
| 4,191,322 | * | 3/1980 | Kinney | 229/5.8 |
| 4,349,400 | * | 9/1982 | Gilden | 229/400 |
| 4,599,123 | | 7/1986 | Christensson . | |
| 4,619,636 | | 10/1986 | Bogren . | |
| 4,721,500 | * | 1/1988 | Van Handel et al. | 493/152 |
| 4,865,506 | | 9/1989 | Kaminski . | |
| 5,449,337 | | 9/1995 | Konzal . | |
| 5,531,235 | * | 7/1996 | Hassenboehler, Jr. | 131/332 |
| 5,624,367 | | 4/1997 | Budziszewski . | |
| 6,135,936 | * | 10/2000 | Brown et al. | 493/109 |

FOREIGN PATENT DOCUMENTS 4-282235 * 10/1992 (JP) .

* cited by examiner

*Primary Examiner*—Gary E. Elkins
(74) *Attorney, Agent, or Firm*—Burns, Doane, Swecker & Mathis, LLP

(57) ABSTRACT

A bottom for a paper cup is formed by advancing a punch against a paperboard web to push the web against a cutting edge which cuts out a circular cup bottom blank from the web. The punch is kept in a forward state to clamp an outer peripheral portion of the blank immovably against a surface of a sleeve. A reciprocable draw is advanced against a center portion of the blank to push the center portion into a circular opening of the sleeve while maintaining the clamping force, to cause the center portion of the blank to become stretched. The clamping force is then progressively released to permit the outer peripheral portion to enter the opening and become bent to form a lip extending at a substantially right angle. The lip is compressed within a gap formed between the draw and a surface of the opening. Because of the stretching of the blank, pleats formed in the lip are only in the form of micropleats that are flattened in a non-folded over state.

2 Claims, 3 Drawing Sheets

FIG. 6
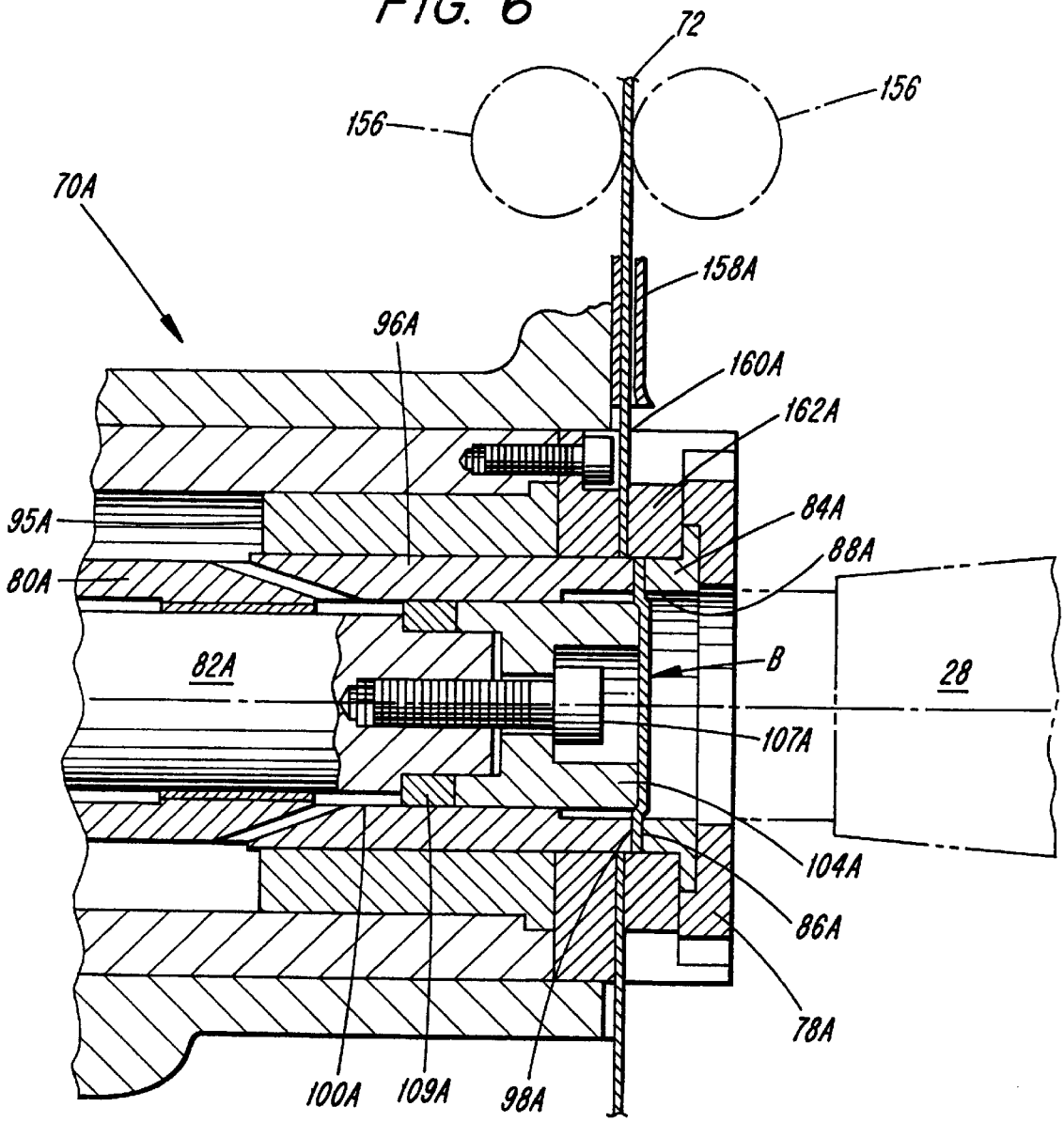
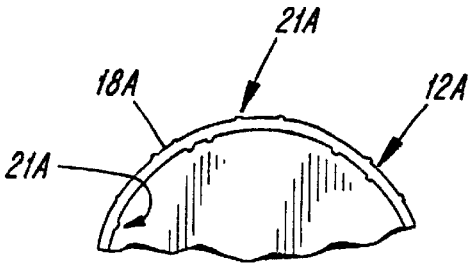
FIG. 7

PAPER CUP BOTTOMS AND METHODS AND APPARATUS FOR FORMING SAME

This Application is a divisional of application Ser. No. 09/251,355 filed Feb. 17, 1999, U.S. Pat. No. 6,135,936, issued Oct. 24, 2000.

BACKGROUND OF THE INVENTION

The present invention relates to cups formed of paperboard and, in particular to methods and apparatus for making a cup bottom that is to be attached to a sidewall of the cup.

In the manufacture of paper cups, i.e. cups made of paperboard material which could optionally be coated with a foamed substance, it is conventional to form a cup bottom and then wrap a cup sidewall around the bottom and attach the sidewall to the bottom by an adhesive.

A longitudinal sectional view through a conventional paper cup 10 is depicted in FIG. 1. As can be seen therein, the cup includes a bottom 12 and a sidewall 14 attached thereto. The bottom 12 comprises a disk-shaped base 16 and a cylindrical lip or skirt 18 projecting from an outer periphery of the base 16. The sidewall 14 is wrapped around the circumference of the lip 18, and an end 20 of the sidewall is folded over the free edge of the lip 18. The lip 18 thus becomes sandwiched between portions of the cup sidewall and is bonded thereto by an adhesive.

Prior to being wrapped with the sidewall, the cup bottom is formed by passing a paper web across a cutter which cuts out a circular blank. Then a draw pushes the blank through an opening having a smaller diameter than the blank. Hence, an outer periphery of the blank is bent over to form the lip, the lip being squashed as it travels through a gap between the draw and a surface of the opening. A conventional apparatus for the manufacture of the cup bottoms is disclosed in Budziszewski U.S. Pat. No. 5,624,367, the disclosure of which is incorporated by reference herein.

It will be appreciated that the lip-forming outer periphery of the blank has a first circumference before the bending, and a smaller circumference after the bending. That means that there is extra paper material after bending, and that extra paper material produces pleats 21, 22 which project from the surface of the lip (see FIG. 2). The pleats extend axially (i.e., in a vertical direction when the cup sits upright). Some of the pleats 21 project by a small distance from the lip surface (i.e. they have a very a short height) and do not present problems, because they will become flattened when the lip is compressed in the gap, as shown in FIG. 2. Other pleats 22, however, are tall enough to become folded over when the lip is compressed in the gap. Such folded-over pleats can produce leakage paths between the lip and the cup sidewall which permit liquid to leak from the cup.

The apparatus disclosed in U.S. Pat. No. 5,624,367 attempted to deal with that problem by producing radial score lines in the outer periphery of the blank prior to the bending. The score lines constitute pre-weakened regions of the blank. It was anticipated that the pleats would be formed in a controlled manner along the score lines, and that the problem of folded-over pleats would be eliminated. That proposal has not met with complete success, because folded-over pleats are still formed in the cup bottom.

It is, therefore, an object of the present invention to produce cup bottoms having only pleats which are not tall enough to become folded-over when the bottom lip is compressed.

SUMMARY OF THE INVENTION

The present invention relates to a method of forming a bottom for a paper cup. The method comprises the steps of:

A. applying a clamping force to an outer peripheral portion of a circular paperboard blank;

B. pushing a center portion of the blank into a circular opening of smaller diameter than the blank while maintaining the clamping force to prevent movement of the outer peripheral portion, whereby the blank becomes stretched; and C. progressively releasing the clamping force following the stretching of step B, to permit the outer peripheral portion to enter the opening and become bent at a substantially right angle relative to the center portion.

The invention also pertains to a method of making a paper cup, wherein a bottom is formed as described above, and wherein a paperboard cup-sidewall blank is wrapped around an end edge of the lip and secured thereto.

The invention also pertains to a cup bottom comprising a one-piece paperboard element including a circular center portion and a bent-over generally cylindrical lip portion projecting from an outer periphery of the center portion at a substantially right angle. The lip portion includes pleats extending parallel to a longitudinal axis of the lip portion. All of the pleats are in the form of micropleats that are flattened in a non-folded over state.

The invention further pertains to a cup which comprises a bottom as described above, and further including a cup sidewall which is wrapped around an end edge of the lip portion and secured to the lip portion.

BRIEF DESCRIPTION OF THE DRAWING

The objects and advantages of the invention will become apparent from the following detailed description of a preferred embodiment thereof in connection with the accompanying drawing in which like numerals designate like elements and in which:

FIG. 6 is a view similar to FIG. 4 depicting a machine modified in accordance with the present invention and in the process of stretching a blank that has been punched from the web; and FIG. 7 is a view similar to FIG. 2 of a bottom formed in accordance with the present invention.

DETAILED DESCRIPTION OF A PREFERRED EMBODIMENT OF THE INVENTION

A machine which can be adapted for making a cup bottom according to the present invention is disclosed in U.S. Pat. No. 5,624,367, the disclosure of which is incorporated herein by reference. As will be explained, that mechanism is modified by removing projections from an abutment surface of a sleeve member, arranging a cam to provide a desired motion of the draw punch, and repositioning a blanking punch head.

Figure 4:
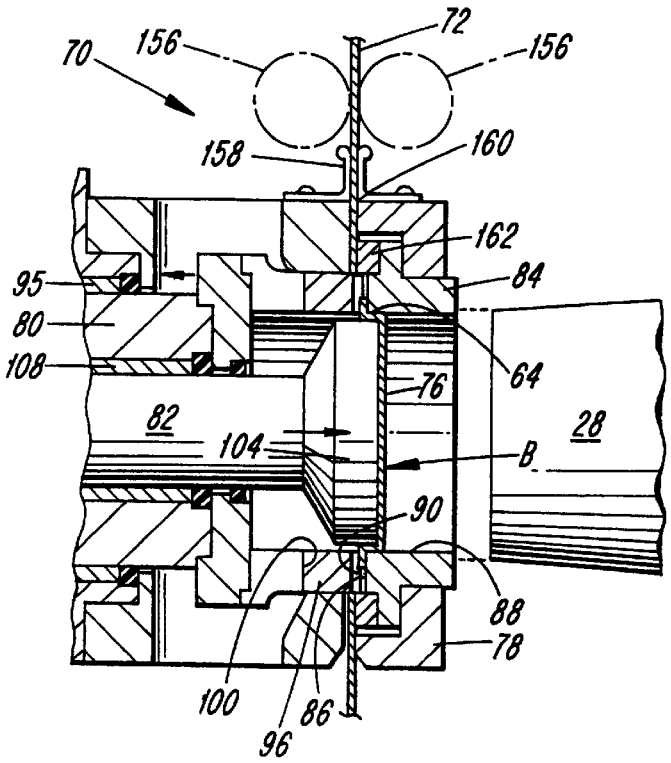
FIG. 4 (PRIOR ART)
FIG. 4 is a view of the conventional machine similar to FIG. 3 after the punch has formed the blank, and a draw of the machine is pushing the blank through an opening.
Figure 3:
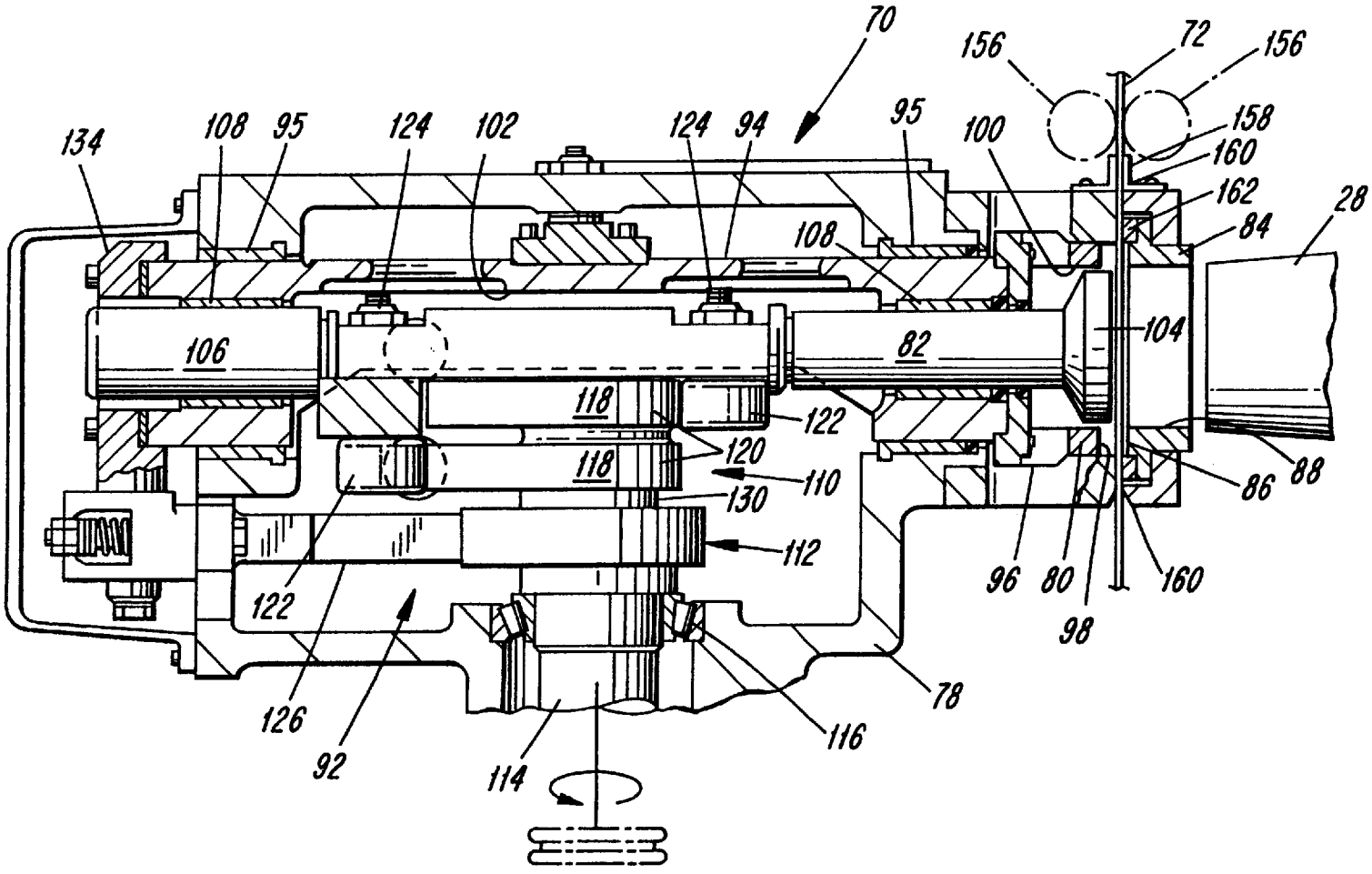
FIG. 3 (PRIOR ART)
FIG. 3 is a longitudinal sectional view taken through a conventional machine for making the cup bottom depicted in FIG. 2, with the machine having a punch thereof poised to sever a blank from a paper web.

Briefly, with reference to FIGS. 3 and 4, a cup bottom making mechanism 70 is disclosed which includes a framework 78 on which is mounted a reciprocable punch 80 and a reciprocable draw 82. The punch 80 and draw 82 interact with a sleeve member 84 having a flat abutment surface 86 and an opening 88 formed by an inner cylindrical surface. Abutment surface 86 is disposed to cooperate with the punch 80 and is generally transverse to the opening 88 which is oriented to allow movement of reciprocable draw 82 therethrough. A reciprocation assembly 92 is connected to punch 80 and draw 82 to selectively slide them into and out of cooperation with sleeve member 84. The reciprocable punch 80 includes a punch head 96 and a tail section 94 slidably mounted in framework 78 on a pair of slides 95. The inside of the annular punch head 96 is defined by a cylindrical surface 100 along which reciprocable draw 82 may move. Preferably, tail section 94 also includes an open or hollow interior 102 to permit draw 82 to reciprocate generally through the center of punch 80.

Draw 82 includes a draw head 104 which is configured to move along inner cylindrical surface 100 of punch head 96 and the inner cylindrical surface of opening 88. Draw head 104 is connected to draw rod 106 that is slidably mounted within hollow interior 102 of punch 80, preferably on a pair of slides 108.

Reciprocation assembly 92 is connected to punch 80 and draw 82 to move the punch into cooperation with the abutment surface 86. Assembly 92 also moves draw 82 through sleeve member 84 and into cooperation with a mandrel 28. The reciprocation assembly includes a draw subassembly 110 and a punch subassembly 112. The entire reciprocation assembly 92 is powered by an input shaft 114 rotatably mounted in framework 78 by bearing 116. Input shaft 114 may be driven by any conventional mechanisms known to those of ordinary skill in the art.

Draw subassembly 110 preferably includes a pair of cams 118 mounted to input shaft 114. Each cam 118 includes a cam surface 120 that acts against a corresponding cam follower 122. Cam followers 122 are attached to a midsection of draw rod 106 by a fastener 124, such as a bolt and nut, wherein the bolt extends through a bore 125 formed through draw rod 106. The cam followers 122 are preferably disposed on opposite sides of the pair of cams 118 and each cam surface 120 has generally the same profile so draw 82 is reciprocated towards and away from the adjacent mandrel 28 as input shaft 114 is rotated.

Punch subassembly 112 includes an arm 126 having a circular opening 128 mounted over input shaft 114. An eccentric 130 is attached to input shaft 114 and rotates within circular opening 128, preferably within a bearing such as ball bearing 132 (see FIG. 14). Thus, as input shaft 114 rotates, eccentric 130 forces arm 126 to reciprocate. Arm 126 is also attached to a back plate 134 of punch 80 to further reciprocate punch 80 as input shaft 114 rotates.

In operation, a paperboard web 72 is fed between a pair of rollers 156 so that the web 72 enters a front portion of framework 78 through a guide member 158 and a slot 160 disposed through framework 78. The orientation of slot 160 directs web 72 to a cutting position in which sleeve member 84 is disposed on the mandrel side of web 72, while punch head 96 and draw head 104 are disposed on the opposite side of web 72 from sleeve member 84. Web 72 preferably rests against a cutter, such as cutter ring 162, at a slight distance from abutment surface 86 and protrusions 90.

Thus, when punch 80 is moved towards sleeve member 84 by the reciprocation assembly 92, punch surface 98 forces web 72 against cutter ring 162 and cuts free a circular bottom blank B. Reciprocation assembly 92 continues to move punch 80 forward until the bottom blank is clamped against the abutment surface 86.

Figure 5:
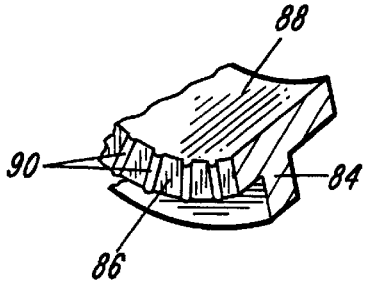
FIG. 5 (PRIOR ART)
FIG. 5 is a fragmentary perspective view of a surface of the conventional machine against which the blank is pushed after being punched out by the punch.

Depicted in FIGS. 4 and 5 are views from U.S. Pat. No. 5,624,367 showing that the abutment surface 86 is provided with projections 90 for the purpose of creating score lines in the outer peripheral portion of the blank. Those score lines are intended to constitute pre-weakened regions of the blank to control the number, location, and hopefully the size of pleats that are formed in the blank when the blank is pushed through the opening 88 while the punch 80 is being retracted (see FIG. 4). The patent is not specific as to the exact timing sequence governing the rearward (leftward) retraction of the punch 80 and the forward (rightward) advancement of the draw 82. Moreover, in a machine made by the assignee of U.S. Pat. No. 5,624,367, the punch 80 is completely withdrawn before the blank enters the opening 88.

The present invention operates under a different principle. That is, rather than scoring the blank to form pre-weakened regions, the present invention avoids scoring and allows the blank itself to establish internal stress lines by causing the blank to be radially stretched prior to the outer periphery being bent over.

Depicted in FIG. 6 is a cup bottom making mechanism 70A according to the present invention which includes a framework 78A on which is mounted a reciprocable punch 80A and a reciprocable draw 82A. The punch 80A and draw 82A interact with a sleeve member 84A having a flat abutment surface 86A and an opening 88A formed by an inner cylindrical surface. The flat abutment surface 86A is disposed to cooperate with the punch 80A and is generally transverse to the opening 88A which is oriented to allow movement of reciprocable draw 82A therethrough. A reciprocation assembly generally similar to the assembly 92 previously described is connected to punch 80A and draw 82A to selectively slide them into and out of cooperation with sleeve member 84A. The reciprocable punch 80A includes a punch head 96A slidably mounted in framework 78A on a pair of slides 95A. The inside of the annular punch head 96A is defined by a cylindrical surface 1OOA along which reciprocable draw 82A may move.

Draw 82A includes a draw head 104A which is configured to move along inner cylindrical surface 100A of punch head 96A and the inner cylindrical surface of opening 88A. The axial position of draw head 104A is adjustable by means of a bolt 107A and a shim 109A.

The reciprocation assembly is connected to punch 80A and draw 82A to move the punch into cooperation with the abutment surface 86A, and to move draw 82A through sleeve member 84A and into cooperation with a mandrel 28.

In operation, a paperboard web 72 is fed between a pair of rollers 156 so that the web 72 enters a front portion of framework 78A through a guide member 158A and a slot 160A disposed through framework 78A. The orientation of slot 160A directs web 72 to a cutting position in which sleeve member 84A is disposed on the mandrel side of web 72, while punch head 96A and draw head 104A are disposed on the opposite side of web 72 from sleeve member 84A. Web 72 preferably rests against a cutter, such as cutter ring 162A, at a slight distance from abutment surface 86A.

Thus, when punch 80A is moved towards sleeve member 84A by the reciprocation assembly, punch surface 98A forces web 72 against cutter ring 162A and cuts free a circular bottom blank B. Reciprocation assembly continues to move punch 80A forward until the bottom blank is clamped against the abutment surface 86A.

Unlike the apparatus described in U.S. Pat. No. 5,624,367, the abutment surface 86A is not provided with projections for the purpose of creating score lines in the outer peripheral portion of the blank. Furthermore, the angular position of the cams 118 relative to that of the eccentric 130 of the prior art machine is changed so that the draw 82A begins to push the central portion of the blank into the opening 88A while the outer peripheral portion of the blank remains firmly (immovably) clamped between the punch 80A and the abutment surface, as shown in FIG. 6. That causes the non-clamped central portion of the blank to be radially stretched. Then, after a slight amount of stretching has occurred, the punch 80A begins to be retracted to progressively reduce the clamping force, allowing the outer peripheral portion to be pulled into the opening 88A. The retraction is performed at a rate just sufficient to prevent the paper from ripping. The radial gap between the outer cylindrical surface of the draw 82A and the cylindrical surface of the opening 88A is slightly less than the thickness of the blank passing through the gap so that the paper becomes compressed. Thus, the outer peripheral portion is bent to a right angle relative to the center part of the blank, and is also compressed.

Figure 1:
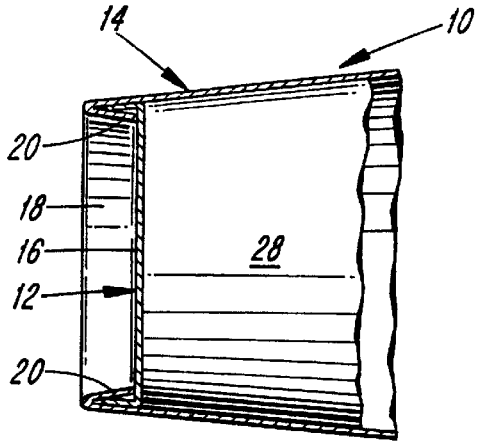
FIG. 1 (PRIOR ART)
FIG. 1 is a fragmentary longitudinal sectional view taken through a lower portion of a prior art paper cup.
Figure 2:
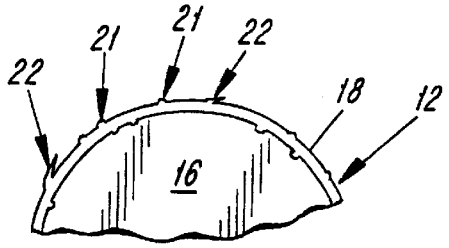
FIG. 2 (PRIOR ART)
FIG. 2 is a fragmentary end view of a prior art paper bottom for use in making a paper cup.

It has been found that the stretching of the blank as the blank is pushed into the opening results in the forming of a blank 12A having many pleats formed in the lip 18A thereof as the lip is being bent over in the opening 88A. The number of pleats is great enough to take-up the surplus paper material caused by the bending-over of the lip. Importantly, only micropleats are formed, i.e. pleats that are not tall enough to be folded over (i.e. folded over in the manner shown at 22 in FIG. 2) while the lip 18A is being compressed in the radial gap between the draw 82A and the surface of the opening 88A. Instead, all of the pleats are effectively squashed, resulting in relatively smooth cylindrical surfaces on the lip 18A as shown in FIG. 7. Consequently, when a sidewall blank is wound around the lip to form the cup sidewall 14, no folded-over pleats are present which could produce leak-inducing passages.

If desired, the paperboard web 72 could be pre-moistened in order to facilitate the stretching.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A cup bottom comprising a one-piece paperboard element including a circular center portion and a bent-over cylindrical lip portion projecting from an outer periphery of the center portion at a substantially right angle, the lip portion including pleats extending parallel to a longitudinal axis of the lip portion, all of the pleats being in the form of micropleats that are flattened in a non-folded-over state.

2. A cup comprising a paperboard cup bottom and a paperboard cup sidewall attached thereto, the cup bottom comprising a one-piece paperboard element including a circular center portion and a bent-over cylindrical lip portion projecting from an outer-periphery of the center portion at a substantially right angle, the lip portion including pleats extending parallel to a longitudinal axis of the lip portion, all of the pleats being in the form of micropleats that are flattened in a non-folded-over state, the cup sidewall being wrapped around a circumference of the lip portion and folded over an end edge of the lip portion and secured to the lip portion.

* * * * *